United States Patent [19]

Gosciniak et al.

[11] Patent Number: 4,580,605

[45] Date of Patent: Apr. 8, 1986

[54] LENO SELVEDGE FORMING DEVICE

[75] Inventors: Guy Gosciniak, Heimsbrunn; Pascal Scherrer, Mulhouse, both of France

[73] Assignee: Societe Alsacienne de Construction de Material Textile, Mulhouse, France

[21] Appl. No.: 625,800

[22] Filed: Jun. 28, 1984

[30] Foreign Application Priority Data

Jul. 8, 1983 [FR] France ..... 83 11409

[51] Int. Cl.[4] ..... D03D 47/40

[52] U.S. Cl. ..... 139/54; 139/430

[58] Field of Search ..... 139/54, 430

[56] References Cited

U.S. PATENT DOCUMENTS 3,561,496 2/1971 Guallo ..... 139/54

FOREIGN PATENT DOCUMENTS 2329302 6/1973 Fed. Rep. of Germany ..... 139/54

4751914 10/1968 Japan ..... 139/54

*Primary Examiner*—Henry S. Jaudon

*Assistant Examiner*—Joseph S. Machuga

*Attorney, Agent, or Firm*—McDougall, Hersh & Scott

[57] ABSTRACT

The invention relates to the textile industry and, more particularly, to weaving machines.

The device comprises: a support (1) to be fixed on the weaving machine; a first lever (2) oscillating on the said support and provided with at least one tongue (3) which has at its end an eye (27) for guiding an additional warp thread; a second lever (6) also oscillating on the support (1) and provided with two bars (7) which are mounted in sliding fashion against each other in a direction parallel with the fell and which each have at least one eye for guiding a crossing thread; means (15, 16, 34, 35) for actuating pivoting of the two oscillating levers (2, 6); and means (49, 55, 65) for actuating sliding of the bars (7) for guiding the crossing threads, arranged so that each crossing thread passes alternately on either side of the corresponding additional warp thread.

The invention is applicable to shuttleless weaving machines.

12 Claims, 21 Drawing Figures

Figure 1:
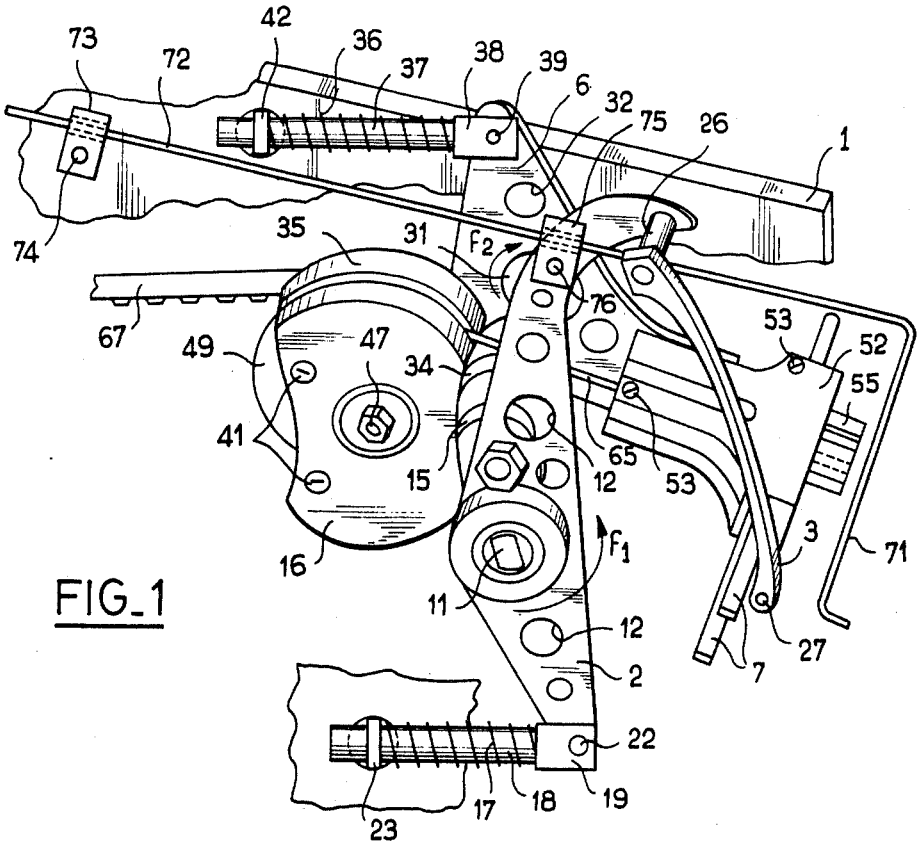

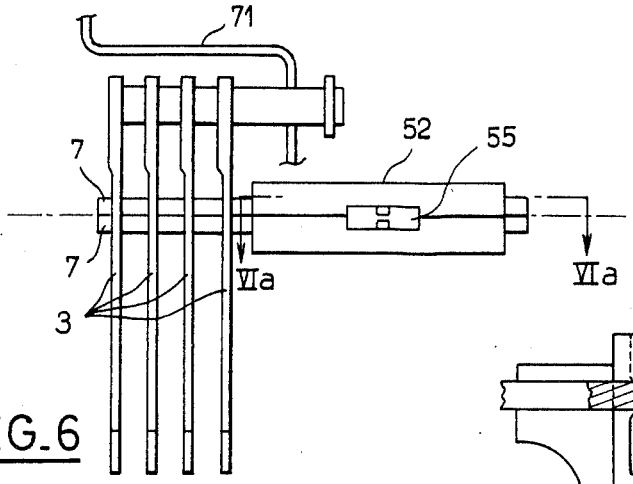
FIG. 6
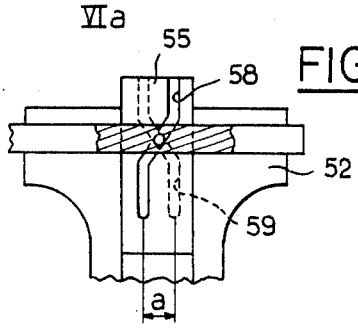
FIG. 6a
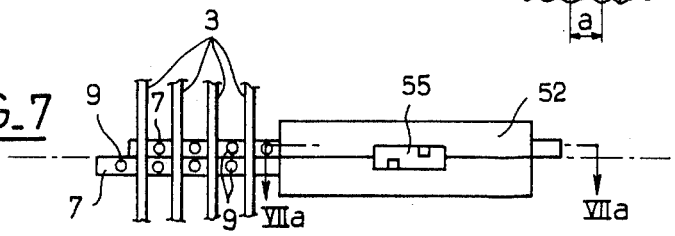
FIG. 7
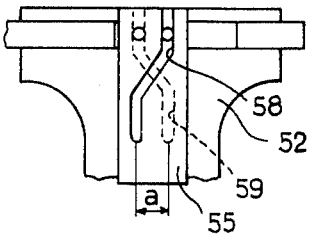
FIG. 7a
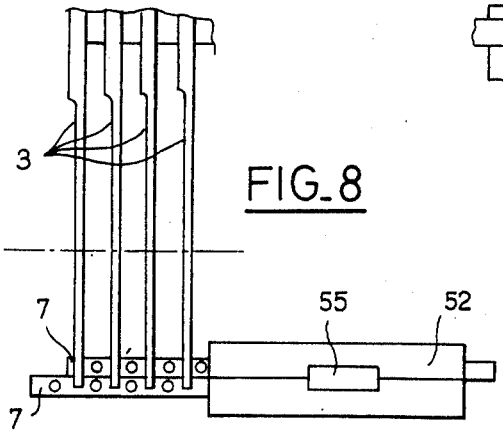
FIG. 8
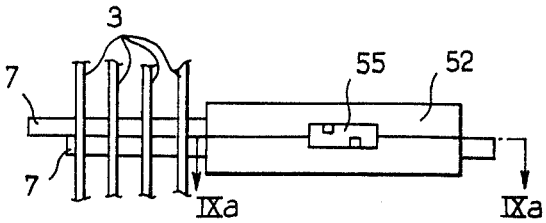
FIG. 9
FIG. 9a
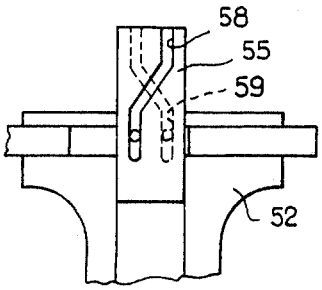

LENO SELVEDGE FORMING DEVICE

The invention relates to producing false selvedges on weaving machines by means of at least one additional warp thread and two crossing threads which are cross-worked so as to form a gauze shed.

Such false selvedges are used to strengthen the edges of the fabric when the latter is made on shuttleless weaving machines where each successive pick is cut close to the edge of the width of cloth, after insertion into the shed.

To obtain such false selvedges, use is frequently made of devices which are mounted in additional frames of the weaving machine's harness, but the alternating movements of these devices limit their operating speed to values well below those required by modern weaving machines, which are being called upon to operate at increasingly greater speeds.

The French Pat. No. 2,390,524 of Aug. 12, 1978 also discloses, for example, a device which performs only continuous circular movements, but the parts forming it are relatively bulky and the device is concerned only with the movement of the crossing threads and not with that of the additional warp threads; moreover, the device permits only the formation of false selvedges which comprise only one additional warp thread associated with two crossing threads.

The object of the invention is to provide a device for forming false selvedgs, which does not have the above-mentioned disadvantages of the devices mentioned previously.

To this end, the device according to the invention comprises: a support to be fixed on the weaving machine alongside one end of the shed, a first oscillating lever mounted so as to pivot on a spindle carried by the said support and parallel to the fell, the said lever being provided with at least one tongue which has at its end an eye for guiding an additional warp thread, the amplitude of the oscillating movements and the path of travel of the said first oscillating lever being such that the eyes of the tongues move between the plane of one of the sheets of the shed and a position located beyond the bisecting plane of the shed, a second oscillating lever also mounted so as to pivot on a spindle carried by the support and parallel to the fell, the said lever being provided with two bars which are parallel to the fell and are movable against each other in a direction parallel to the fell and which each have at least one eye for guiding a crossing thread, the amplitude of the oscillating movements and the path of travel of the said second oscillating lever being such that the eyes for guiding the crossing threads move between the plane of the other sheet of the shed and a position located beyond the bisecting plane of the shed, means for actuating pivoting of the two oscillating levers with the aid of a primary rotating element swivelling on the support, which means are designed so that the eyes of the tongues for guiding the additional warp threads and the eyes of the bars for guiding the crossing threads have opposite phasing, at a rate which is a submultiple of that of the formation of the shed, and means for actuating the bars for guiding the crossing threads by converting the rotating movement of the primary rotating element into an alternating movement of relative displacement of the two bars, so that they move, in opposite directions, in the vicinity of one of the ends of the travel of the second oscillating lever, which carries them, and the length and the path of travel of each bar being such that each eye for guiding a crossing thread passes alternately on either side of the vertical plane in which the corresponding additional warp thread is located.

Such a device has only parts which are light and small in size and does not involve abrupt alternating movements, so that it is able to reach high speeds; it does not require, for itself alone, the use of any harness frame; finally, it permits the formation of false selvedges which have any number of additional warp threads and, therefore, are very solid, as is required by the structure of certain fabrics.

The invention will be better understood upon reading of the description which follows and upon examination of the attached drawings which show, by way of example, two embodiments of a device for producing a false selvedge according to the invention.

Figure 2:
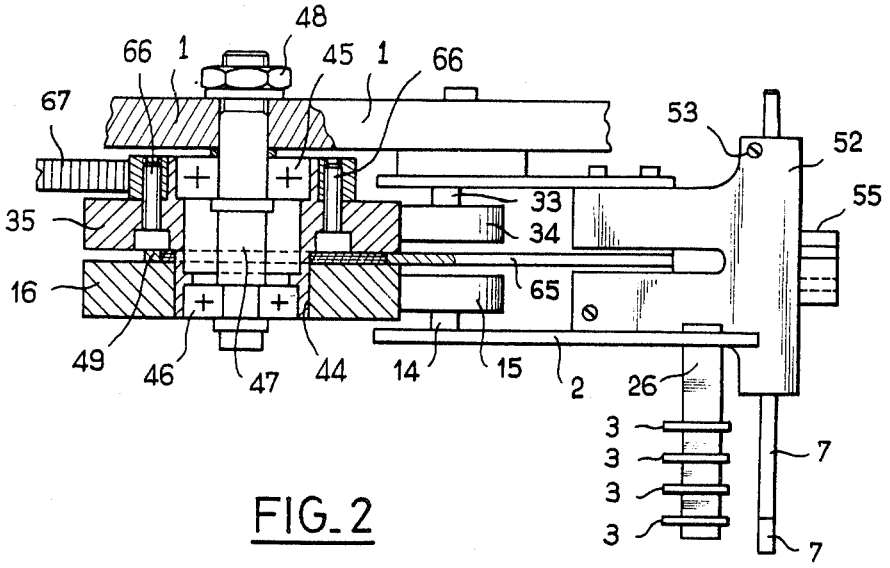
Figure 3:
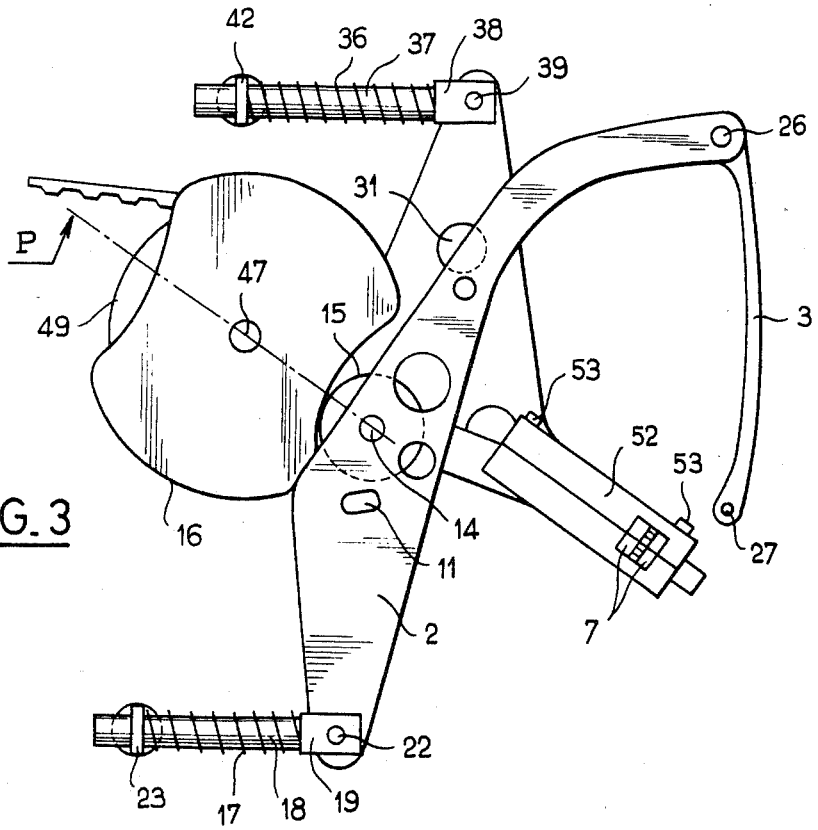
Figure 4:
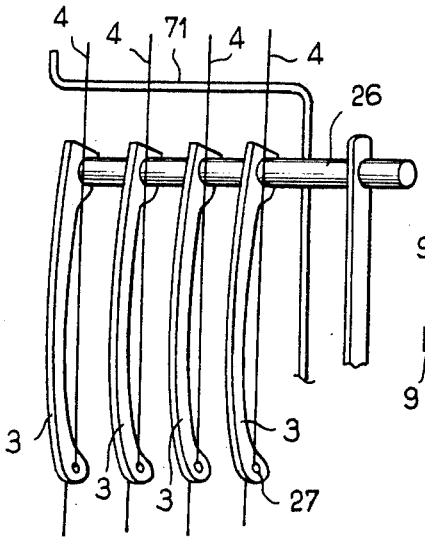
Figure 5:
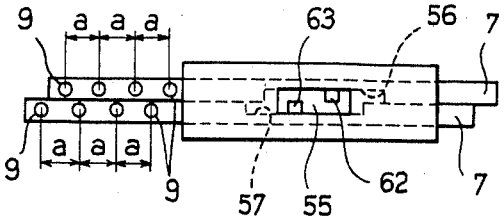
Figure 10:
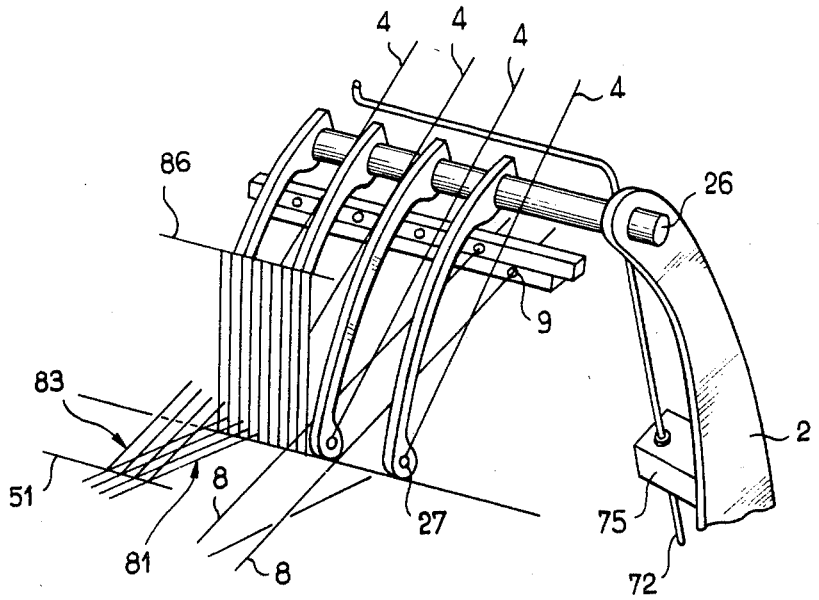
Figure 11:
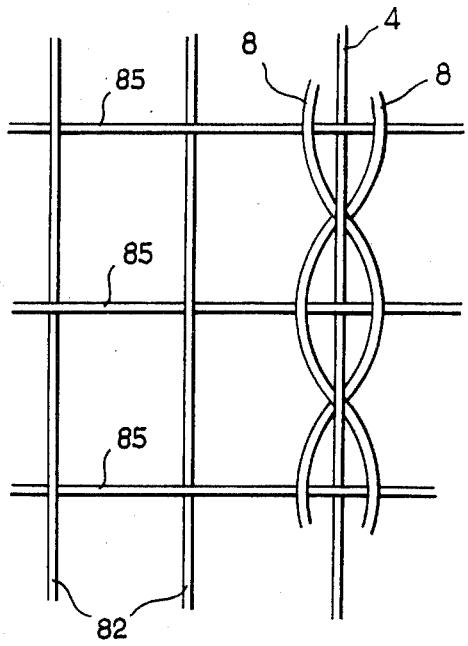
Figure 12:
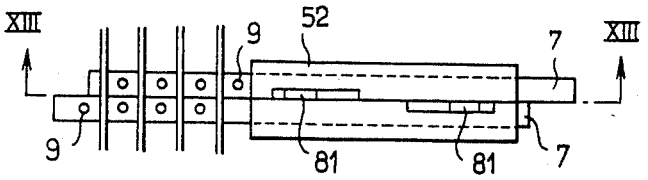
Figure 13:
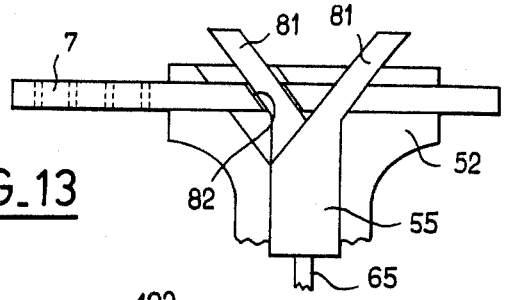
Figure 14:
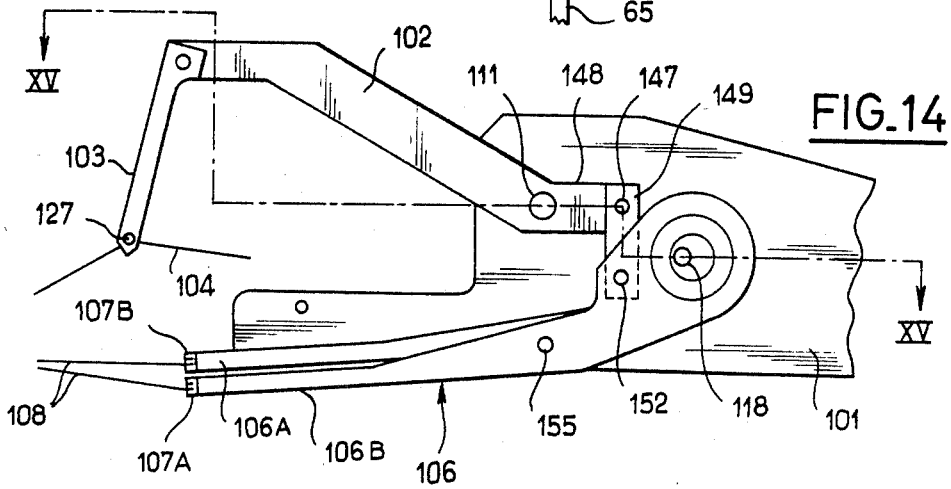
Figure 15:
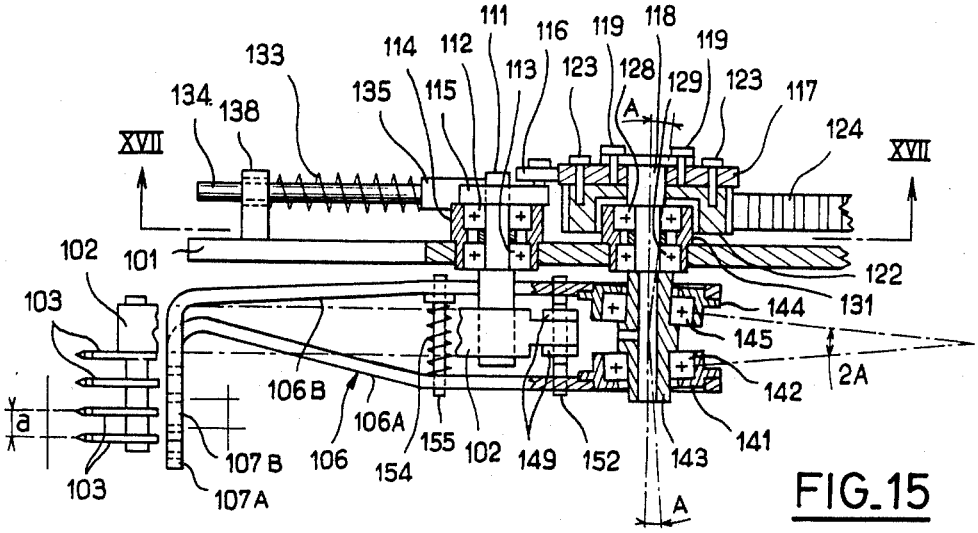
Figure 16:
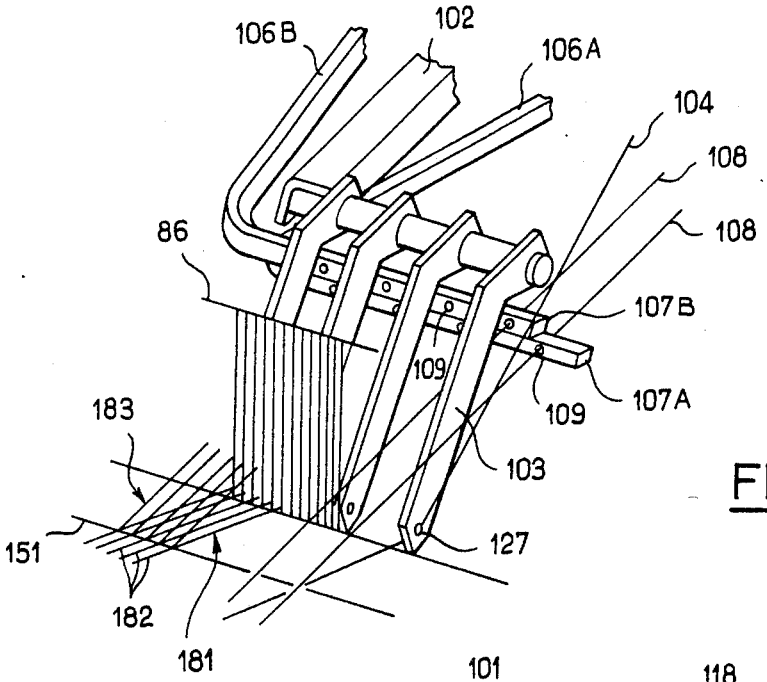
Figure 17:
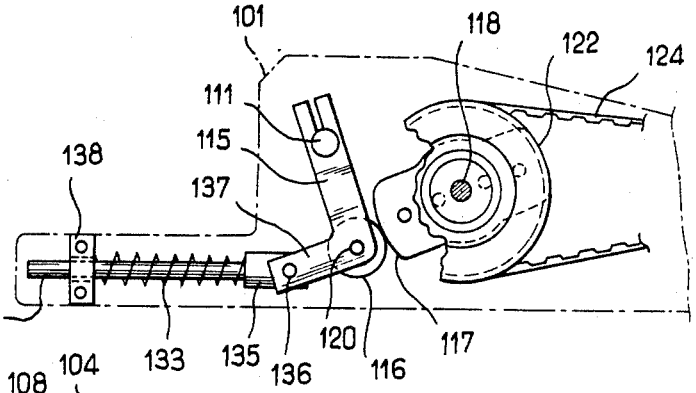
Figure 18:
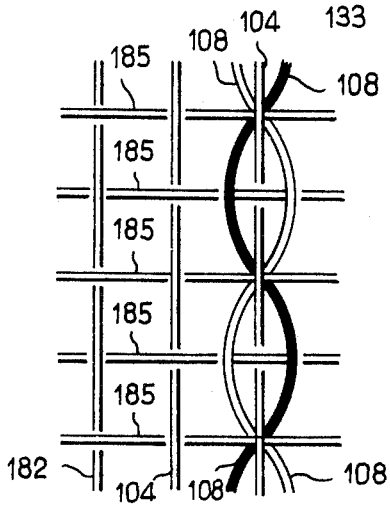

In these drawings,

FIG. 1 is a perspective view of a first embodiment, it being imagined that the device is positioned on one side of a weaving machine and is observed both from this side and from slightly above, FIG. 2 is a top view of the main elements of the device shown in FIG. 1, FIG. 3 is a side view observed in the same direction as in FIG. 1, FIG. 4 is a perspective view of all the tongues for controlling the auxiliary warp threads for the false selvedge, observed from the side and from the front of the machine, FIG. 5 is a front view of the bars for controlling the crossing threads for the selvedge and of their actuating mechanism, FIGS. 6 to 9 are front views illustrating the cooperation of the mechanisms for controlling the additional warp threads and the crossing threads for the selvedge, FIG. *6a*, *7a* and *9a* are partial horizontal sections along the lines VIa—VIa, VIIa—VIIa and IXa—IZa, respectively, of FIGS. 6, 7 and 9, FIG. 10 is a perspective view, observed from the front of the machine, showing the positioning of the device for forming the false selvedge with respect to the shed and the reed, FIG. 11 shows, on a large scale, the structure of the false selvedge obtained on one of the additional warp threads, FIG. 12 is a front view of the type illustrated in FIG. 5, showing a variant of the machanism for actuating the bars, FIG. 13 is a section along the line XIII—XIII of FIG. 12, FIG. 14 is a side view of a second embodiment of the invention, FIG. 15 is a section made substantially along the broken line XV—XV of FIG. 14, FIG. 16 is a perspective view, observed from the front of the machine, showing the position of the device for forming the false selvedge with respect to the shed and the reed, FIG. 17 is a vertical section along the line XVII—XVII of FIG. 15, and FIG. 18 shows, on a large scale, the structure of the false selvedge obtained on one of the additional warp threads with the device of FIGS. 14 to 17.

The device for producing a false selvedge, shown in FIG. 1, comprises a support 1 to be fixed on a weaving loom alongside one end of the shed. It is understood that, to produce a false selvedge at the other end of the shed, a similar device would be placed on the other side of the loom. The support 1 has mounted on it a first oscillating lever 2, which carries tongues 3 for controlling the additional warp threads 4 for forming the selvedge (see FIG. 10 also), and a second oscillating lever 6, which carries sliding bars 7 for controlling the crossing threads 8. In practice, the false selvedges of the type in question comprise several, for example four, additional warp threads and double the number of crossing threads, i.e. eight in the example. FIG. 1, for the sake of clarity of the drawing, shows only one tongue 3 for controlling the additional warp threads, whereas the other figures show four of them; as for the two bars 7, they each have four eyes 9 (FIGS. 5 and 7 for example), which are separated from each other by intervals "a", and are therefore able to control together eight crossing threads which are threaded respectively in the said eyes.

The first oscillating lever 2 is mounted so as to pivot freely, at an intermediate point along its length, on a first spindle 11 fixed to the support 1; it has openings, such as those designated 12, which are intended to make it lighter. One of its arms carries a spindle 14 (see also FIGS. 2 and 3) which has mounted on it an idle roller 15 in contact with a cam 16 due to the action of a return spring 17, which is a helical compression spring threaded on a rod 18 and one end of which, in the form of a yoke 19, is articulated, via a spindle 22, to the end of the other arm of the oscillating lever 2, whereas the other end of the rod 18 slides, with play, in a guide 23 mounted on the support 1; the spring 17 is therefore retained between this guide and the base of the yoke 19 so that it forces the lever 2 to pivot on the spindle 11 in the direction of the arrow f1, thereby tending to apply the roller 15 against the cam 16. The tongues 3 are fixed, at one of their ends, to the cranked end of the oscillating lever 2 which carries the roller 15, by means of a small column 26; they extend in vertical planes which are parallel to the warp threads and also separated from each other by intervals "a", their other end having an eye 27 through which the corresponding additional warp thread 4 passes. The eyes 27 are aligned in a direction parallel to the fell 51 (FIG. 10).

The second oscillating lever 6 is also mounted idle, at an intermediate point along its length, on a second spindle 31 fixed on the support 1; it also has openings intended for lightening, such as those designated 32. One of its arms carries a spindle 33 which has mounted on it, idle, a roller 34 in contact with another cam 35 due to the action of a return spring 36 threaded on a rod 37 one end of which, in the form of a yoke 38, is articulated, via a spindle 39 to the end of the other arm of this second oscillating lever 6, whereas the other end of the rod 37 slides, with play, in a guide 42 mounted on the support 1; the spring therefore forces the lever to pivot on the spindle 31 in the direction of the arrow f2 (FIG. 1), thereby tending to apply the roller 34 against the cam 35.

The cam 35 has a shouldered hub 44 (FIG. 2) which constitutes a primary rotating element and in which are force-fitted the outer rings of two ball bearings 45, 46 the inner rings of which are clamped on a shouldered spindle 47 which is itself fixed to the support 1 by means of a nut 48 screwed onto the corresponding threaded end of the said spindle. The first cam 16 is fixed onto the cam 35 by means of two screws 41 (FIG. 1) and has a central hole with a polygonal shape, for example a square, threaded on a part which has a prismatic cross-section and is connected to the external surface of the hub 44 of the cam 35. An eccentric 49 (which will be described later) is clamped between these two cams and is likewise threaded on the polygonal part of the hub.

As shown, the two cams have profiles with a general cylindrical shape and with two diametrically opposed recesses, the recesses of one of the cams being substantially opposite the recesses of the other one. In this example, furthermore, the two rollers 15, 34 are located substantially in a same radial geometric plane P (FIG. 3) of the camshaft 47, whereas the spindles 11, 31 for pivoting the two oscillating levers 2, 6 are located respectively on either side of this geometric plane, so that the two oscillating levers 2 and 6 pivot approximately at the same time, but in opposite directions on account of the general arrangement of the assembly.

The arm of the second oscillating lever which already carries the roller 34 also carries the bars 7 for controlling the crossing threads, through the intermediacy of a housing 52 which is integrally fixed to the said lever and formed by two half-shells assembled one on top of the other by screws 53. The bars 7 slide in this housing, in a direction which is parallel to all of the abovementioned spindles and at the same time parallel to the fell 51, with opposite phasing, due to the action of slide 55 (see also FIGS. 5 to 9) which slides in the housing 52 in a direction perpendicular to that of the bars 7; the slide 55 is accommodated in recesses 56, 57, wider than the said slide, in the faces opposite the two bars and it has on its opposite faces two cam-grooves 58, 59 whose projections intersect and in which are engaged, respectively, two studs 62, 63 which themselves are fixed, respectively, in the two bars 7. The spacing "a" between the two cam-grooves is equal to the spacing of the eyes 7 of the bars and to the spacing of the tongues 3 for controlling the additional warp threads. When both bars 7 are in their central intermediate position (FIGS. 6, **6*a*), that is to say when the two studs 62, 63 are coaxial, the eyes 7 of the bars are in the median vertical planes of the tongues 3. The slide 55 is actuated by a rod 65 connected to the eccentric 49** mentioned above.

The two cams 16, 35 as well as the eccentric 49 are driven together, continuously and always in the same direction, by means of a drive which comprises a toothed pulley fixed on the hub 44 of the cam 35 by means of screw 66 and a notched belt 67 which passes over this pulley and over another pulley (not shown) which itself is driven by a shaft whose speed of rotation is linked to that of the crankshaft of the weaving machine. The drive ratio is such that the cam and the eccentric perform only one complete revolution while the crankshaft of the machine performs two revolutions, that is to say that the two oscillating levers 2 and 6 are actuated with a frequency equal to that of formation of the shed since the cams each have two recesses, whereas the eccentric 49 and the slide 55 are actuated at a frequency which is only a half of the former. As a result, the tongues 3 along with the bars 7 dive into the dihedral angle of the shed, each time a shed is formed, whereas the same bars 7 move alternately, in one direction or the other, only when a new shed is formed and therefore resume their initial position in the case of only one shed out of two.

The amplitude of the oscillating movements and the path of travel of the said first oscillating lever 2 are such that the eyes 27 of the tongues 3 for guiding the additional warp threads move between the plane of one of the sheets of the shed and a position located beyond the bisecting plane of the shed; in the present example, the eyes 27 move between a low position situated in the plane of the lower sheet 81 (FIG. 10) of the shed and a high position situated above the bisecting plane of the shed, but very close to this plane.

The amplitude of the oscillating movements and the path of travel of the second oscillating lever 6 are such that the eyes 9 of the bars 7 for guiding the crossing threads 8 move between the plane of the other sheet of the shed and a position located beyond the bisecting plane of the shed; in the present example, the eyes 9 move between a high position situated in the plane of the upper sheet 83 (FIG. 10) of the shed and a low position situated below the bisecting plane of the shed, but very close to this plane.

A hook 71 (FIGS. 1, 4 and 10), which is located in the vicinity of the tongues 3, is formed by the end of a long rod 72 which is clamped in a bracket 73 mounted on a pivot 74 fixed on the support 1. The rod 72 is mounted in sliding fashion in another bracket 75 which is mounted on another pivot 76 fixed on the arm of the first oscillating lever 2 which already carries the tongues 3. The hook 71 is parallel to the fell 51 and performs an upward and downward movement in time with a pivoting movement of the first oscillating lever 2; its purpose is to counterbalance the thread floats during formation of the selvedge.

The device operates as follows:

When the rollers 15 and 34 of the two oscillating levers 2 and 6 are in contact with the cylindrical parts of the two cams 16 and 35, respectively, the tongues 3 are in their low position, whereas the bars 7, on the other hand, are in their high position, as shown in FIG. 10; the four additional warp threads 4, in their section situated downstream of the eyes 27 of the said tongues, are located substantially in the plane of the lower sheet 81 of the perpendicular warp threads 82 of the shed, whereas the eight crossing threads 8 are located substantially in the plane of the upper sheet 83 of the shed. On the other hand, when the rollers are in the recesses of the cams, the tongues 3 are in their high position while the bars 7 are in their low position; the additional warp threads 4 are then slightly above the bisecting plane of the shed while the crossing threads are located slightly below this plane. The reed has been denoted by 86.

As can be seen from FIG. 11 shown large-scale, each perpendicular pick 85 is inserted in the shed above an additional warp thread 4 of the selvedge and below the two crossing threads 8, that is to say at a time when the tongues 3 are in their low position, as shown in FIG. 10, and the bars 7 are in their high position. Furthermore, the two crossing threads 8 associated with each additional warp thread 4 must intersect beneath the said additional warp thread, that is to say the relative sliding movement of the two bars 7 must occur at a time when the tongues 3 are in the high position and the bars 7 in the low position. In this way, the false selvedge with the known design referred to as "gauze shed", as shown in FIG. 11, is formed. To achieve these conditions, it is sufficient for the cams 16 and 35 to be appropriately keyed with respect to the main shaft of the weaving machine and for the eccentric 49 to be appropriately keyed with respect to the cams. Thus, on the one hand, the perpendicular picks will be appropriately inserted between the warp threads and the crossing threads of the selvedge and, on the other hand, the crossing threads 8 will be located, when the perpendicular successive picks are inserted, sometimes on the right and sometimes on the left of the corresponding additional warp thread of the selvedge. All the perpendicular picks pass above the additional warp threads of the selvedge and below the crossing threads.

FIGS. 6 to 9 illustrate different operating phases of the device. Thus, FIGS. 6 and 6*a* correspond to the moment when the crossing threads 8 intersect below the additional warp threads as a result of the relative sliding of the two bars 7; FIGS. 7 and 7*a* show the positions of the bars 7 with respect to the tongues 3 during insertion of a perpendicular pick 85 of fabric being manufactured; in FIG. 8, the tongues 3 are raised and the bars 7 lowered, and insertion of the pick has been completed; finally, in FIGS. 9 and 9*a*, the bars have already slid relative to each other, crossing over beneath the additional warp threads so as to prepare the gauze shed which will be formed by insertion of the next perpendicular pick.

FIGS. 12 and 13 show a variant of the mechanism for actuating sliding of the bars 7. The slide 55, instead of having crossed cam-grooves, as in the example described above, ends in two diverging arms 81 which have a V-shape and are engaged in corresponding inclined notches 82 made in the adjacent faces of the two bars 7. The alternating sliding movement of the slide 55 is converted into a simultaneous sliding movement of the two bars in the housing 52, the movement of each bar taking place in a direction opposite to that of the other and in a direction perpendicular to that of the movement of the actuating slide 55, as in the embodiment described above and in the same phase and amplitude conditions, so that the result obtained is the same.

FIGS. 14 to 17 show another embodiment which uses the same general principle as in FIGS. 1 to 13, but in a slightly different arrangement.

The support 101 has on it a first oscillating lever 102 which carries the tongues 103 for controlling the additional warp threads 104 (see FIG. 18 also) for forming the false selvedge and a second oscillating lever 106 which carries bars 107A, 107B for controlling the crossing threads 108.

The first oscillating lever 102 is fixed on a first spindle 111 which is parallel to the fell 151 (FIG. 16) and mounted in two ball bearings 112, 113 (FIG. 15) accommodated in a housing 114 forming a bearing fixed on the support 101. The spindle 111 is imparted an alternating pivoting movement by an actuating system which comprises: a crank 115 (see FIG. 17 also) fixed on the spindle 111, a roller 116 mounted so as to rotate freely on a spindle 120 fixed in the end of this arm, a cam 117 against which the said roller is engaged, a shouldered main actuating spindle 118 on which the cam is fixed by means of screw 119, a toothed pulley 122 fixed against the cam by screws 123 and a notched belt 124 which passes over the toothed pulley 122 as well as over another pulley (not shown) itself driven by a shaft whose speed of rotation is linked to that of the crankshaft of the weaving machine. The drive ratio is such that the cam 117, which has two lobes, performs only one complete revolution while the crankshaft of the weaving machine performs four revolutions. Each time a shed is formed, the lever 102 is therefore lowered or raised. The spindle 118 pivots in two ball bearings 128, 129 which are mounted in a housing 131 forming a bearing fixed on the support 101. The roller 116 is kept constantly in contact with the cam 117 due to the action of a helical compression spring 133 which is threaded on a rod 134 one end of which has a head-piece 135 articulated, via a spindle 136, to a curved extension 137 of the crank 115 and whose part adjacent to the other end slides, with a certain amount of operating clearance, in a guide 138 fixed to the support 101.

The second oscillating lever 106 consists of an assembly of two arms 106A and 106B, the distal ends of which are curved at a right angle parallel to the fell so as to form the two bars 107A, 107B for controlling the crossing threads, whereas their proximal ends are mounted on a second spindle 118 in a very special way. The arm 106A is integrally fixed to a housing 141 which encloses a ball bearing 142 mounted on a first part of a sleeve 143 fixed on the rotating spindle 118 and, in a similar fashion, the arm 106B is integrally fixed to a housing 144 which encloses a ball bearing 145 mounted on the second part of the sleeve 143. The external surfaces of the two abovementioned parts of the sleeve 143 are cylindrical, but they are not coaxial with the geometric axis of the said sleeve; they each form an angle "A" with the said geometric axis, as indicated in FIG. 15. As a result, for the position of the spindle 118 shown in the drawing, the median planes of the two ball bearings 142, 145 form an angle with the value "2A", between each other, and intersect on the right of the Figure. For an angular position of the spindle 118 which is at 180° from that shown, the median planes of the two ball bearings would intersect on the left of the Figure, forming the same angle "2A", and the two arms 106A, 106B, which necessarily follow the planes of the bearings, would draw closer to each other, thereby causing each of the two bars 107A, 107B to move in the opposite direction, by the distance "a", due to the appropriate dimensioning of the various elements of this mechanism, i.e.: the length of the arms 106A, 106B and the value of the angle "2A" of relative inclination of the two bearings 142, 145.

The assembly of the second oscillating lever 106 performs, at the same time, an alternating upward and downward movement imparted by the angular oscillating movement of the spindle 111 by means of a linkage which comprises: a spindle 147 carried by an extension 148 of the first oscillating lever 102, a double connecting rod 149, one end of which is articulated to the spindle 147 and the other end of which is articulated to a spindle 152 engaged simultaneously in holes located in the two arms 106A, 106B. Furthermore, the two arms 106A, 106B are resiliently forced apart from each other by a helical compression spring 154 which is threaded onto a shouldered spindle 155 whose two ends are engaged respectively in two holes bored in the two arms, the spring resting, with one of its ends, against the internal face of the arm 106A and, with its other end, against the shoulder of the spindle. In these conditions, the second oscillating lever 106 performs an upward and downward movement at the same rate as the first oscillating lever 102, but with opposite phasing with respect to the latter, that is to say, when the first lever is in a high position, the second lever is in a low position and, conversely, when the first lever is in a low position, the second lever is in a high position. Furthermore, the general arrangement is such that, for the high and low positions, respectively, of these two oscillating levers, the eyes 127 for guiding the additional warp threads and the eyes 109 for guiding the crossing threads are, in turn, in the plane of each of the two sheets 181, 183 of the shed (FIG. 16).

The device operates as follows:

When the roller 116 is in contact with the lobe of the cam 117, the tongues 3 are in their high position, whereas the bars 107A, 107B, on the other hand, are in their low position, as shown in FIG. 14; the four additional warp threads, with respect to their section located downstream of the eyes 127 of the said tongues, are situated substantially in the plane of the upper sheet 183 of the perpendicular warp threads 182 of the shed, while the eight crossing threads 108 are located substantially in the plane of the lower sheet 181 of the shed. On the other hand, when the roller is in a recess of the cam, the tongues 103 are in their low position while the bars 107A, 107B are in their high position (FIG. 16); the additional warp threads 104 are therefore in the plane of the lower sheet 181 of the shed while the crossing threads 108 are situated in the plane of the upper sheet 183. During crossing over of the two oscillating levers 102, 106 and as a result of the continuous rotation of the main actuating spindle 118, the arms 106A, 106B, supported by their bearings 142, 145 which are mounted obliquely and in opposition to each other, transmit to the two bars 107A, 107B, by means of a half-turn of the spindle 118, forward movements along the path "a", in opposite directions and parallel to the fell, the second half-turn of the spindle corresponding to movements of the two bars which are inverse and in the opposite direction. Thus, one revolution of the spindle 118 corresponds to a forward movement and backward movement of the two bars.

As can be seen from the large-scale drawing of FIG. 18, a first perpendicular pick 185 is inserted into the shed below the additional warp thread 104, the tongues 103 being at this time in a high position, while, at the same time, the bars 107A, 107B are in a low position below the pick and the crossing threads 108 are in the position of crossing over each other.

Continuing the oscillating movement, the tongues 103 fall while the bars 107A, 107B rise in synchronism with the shed, and separate the crossing threads 108 as far as possible so as to allow the passage of the tongues 103 which cause the additional warp threads 104 to fall. Another pick 185 is then inserted and the cycle described above recommences, the same positioning of the crossing threads 108 occurring only every four picks 185. The additional warp threads 104 and the crossing threads 108 are situated alternately above and below the successive perpendicular picks 185. In other words, a complete cycle of the false selvedge with a gauze shed extends over a period in which four sheds are formed, that is to say over four cycles of the weaving machine, whereas the false selvedge of FIG. 11, produced with the device shown in FIGS. 1 to 10, extends over only two cycles of the weaving machine. The main spindle 118 of the device of FIGS. 14 to 17 thus revolves half as fast as the main spindle 47 of the device shown in FIGS. 1 to 10, which is advantageous; furthermore, the false selvedge of FIG. 18 is tighter than that of FIG. 10.

It would, moreover, be possible to produce the false selvedge of FIG. 18 using the device shown in FIGS. 1 to 10, by making the latter rotate half as fast and by adjusting it so that the high position of the additional warp threads and the low position of the crossing threads are located, respectively, just above and just below the bisecting plane of the shed. Conversely, the selvedge of FIG. 10 could be produced using the device shown in FIGS. 14 to 17, by making the latter rotate twice as fast and by adjusting it so that the high and low positions of the additional warp threads as well as those of the crossing threads are all located substantially in the planes of the two sheets of the shed.

We claim:

1. Device for producing a false selvedge on a weaving machine by means of at least one additional warp thread and two crossing threads crossworked so as to form a gauze shed, which comprises:

a support to be fixed on the weaving machine alongside one end of the shed, a first spindle carried by said support and parallel to the fell, a first oscillating lever mounted so as to pivot on said first spindle, at least one tongue provided on said lever, said tongue having at its end an eye for guiding an additional warp thread, the amplitude of the oscillating movements of the path of travel of the said first oscillating lever being such that the eyes of the tongues move between the plane of one of the sheets of the shed and a position located beyond the bisecting plane of the shed, a second spindle carried by said support and parallel to the fell, a second oscillating lever mounted so as to pivot on said second spindle, two bars provided on said second oscillating lever, said bars being parallel to the fell and movable against each other in a direction parallel to the fell and each having at least one eye for guiding a crossing thread, the amplitude of the oscillating movements and the path of travel of said second oscillating lever being such that the eyes for guiding the crossing threads move between the plane of the other sheet of the shed and a position located beyond the bisecting plane of the shed, a primary rotating element rotatably mounted on said support, means operatively connected to said primary rotating element for actuating pivoting of said two oscillating levers, which means being designed so that the eyes of the tongues for guiding the additional warp threads and the eyes of the bars for guiding the crossing threads have opposite phasing, at a rate which is a submultiple of that of the formation of the shed, and bar actuating means operatively connected to said primary rotary element and to said crossing thread guiding bars to impart an alternating movement of relative displacement to said two bars, so that they move, in opposite directions, in the vicinity of one of the ends of the travel of said second oscillating lever which carries them, and the length and location of the path of travel of each bar being such that each eye for guiding a crossing thread passes alternately on either side of the vertical plane in which the corresponding additional warp thread is located, said bar-actuating means comprising two inclined actuating elements which cooperate respectively with matching elements of the two bars.

2. Device for producing a false selvedge on a weaving machine by means of at least one additional warp thread and two crossing threads crossworked so as to form a gauze shed, which comprises:

a support to be fixed on the weaving machine alongside one end of the shed, a first spindle carried by said support and parallel to the fell, a first oscillating lever mounted so as to pivot on said first spindle, at least one tongue provided on said lever, said tongue having at its end an eye for guiding an additional warp thread, the amplitude of the oscillating movements of the path of travel of the said first oscillating lever being such that the eyes of the tongues move between the plane of one of the sheets of the shed and a position located beyond the bisecting plane of the shed, a second spindle carried by said support and parallel to the fell, a second oscillating lever mounted so as to pivot on said second spinder, two bars provided on said second oscillating lever, said bars being parallel to the fell and movable against each other in a direction parallel to the fell and each having at least one eye for guiding a crossing thread, the amplitude of the oscillating movements and the path of travel of said second oscillating lever being such that the eyes for guiding the crossing threads move between the plane of the other sheet of the shed and a position located beyond the bisecting plane of the shed, a primary rotating element rotatably mounted on said support, means operatively connected to said primary rotating element for actuating pivoting of said two oscillating levers, which means being designed so that the eyes of the tongues for guiding the additional warp threads and the eyes of the bars for guiding the crossing threads have opposite phasing, at a rate which is a submultiple of that of the formation of the shed, and bar actuating means operatively connected to said primary rotary element and to said crossing thread guiding bars to impart an alternating movement of relative displacement to said two bars, so that they move, in opposite directions, in the vicinity of one of the ends of the travel of said second oscillating lever which carries them, and the length and location of the path of travel of each bar being such that each eye for guiding a crossing thread passes alternately on either side of the vertical plane in which the corresponding additional warp thread is located, said bar-actuating means comprising two inclined actuating elements which cooperate respectively with matching elements of the two bars, wherein the means for actuating relative displacement of the bars for guiding the crossing threads comprise a slide which slides, with respect to the second oscillating lever, in a direction perpendicular to that of the bars and which is connected to the primary rotating element by the eccentric or similar, the said slide having two inclined actuating elements which cooperate respectively with matching elements of the two bars.

3. Device as claimed in claim 2, wherein the two inclined actuating elements are crossed cam-grooves and the matching elements of the two bars are studs engaged respectively in the said cam-grooves.

4. Device as claimed in claim 2, wherein the two inclined actuating elements are diverging arms which have a V-shape and the matching elements with which they cooperate are corresponding inclined notches made in the adjacent faces of the two bars and in which the said diverging arms are respectively engaged.

5. Device for producing a false selvedge on a weaving machine by means of at least one additional warp thread and two crossing threads crossworked so as to form a gauze shed, which comprises:

a support to be fixed on the weaving machine alongside one end of the shed, a first spindle carried by said support and parallel to the fell, a first oscillating lever mounted so as to pivot on said first spindle, at least one tongue provided on said lever, said tongue having at its end an eye for guiding an additional warp thread, the amplitude of the oscillating movements of the path of travel of the said first oscillating lever being such that the eyes of the tongues move between the plane of one of the sheets of the shed and a position located beyond the bisecting plane of the shed, a second spindle carried by said support and parallel to the fell, a second oscillating lever mounted so as to pivot on said second spindle, two bars provided on said second oscillating lever, said bars being parallel to the fell and movable against each other in a direction parallel to the fell and each having at least one eye for guiding a crossing thread, the amplitude of the oscillating movements and the path of travel of said second oscillating lever being such that the eyes for guiding the crossing threads move between the plane of the other sheet of the shed and a position located beyond the bisecting plane of the shed, a primary rotating element rotatably mounted on said support, means operatively connected to said primary rotating element for actuating pivoting of said two oscillating levers, which means being designed so that the eyes of the tongues for guiding the additional warp threads and the eyes of the bars for guiding the crossing threads have opposite phasing, at a rate which is a submultiple of that of the formation of the shed, and bar actuating means operatively connected to said primary rotary element and to said crossing thread guiding bars to impart an alternating movement of relative displacement to said two bars, so that they move, in opposite directions, in the vicinity of one of the ends of the travel of said second oscillating lever which carries them, and the length and location of the path of travel of each bar being such that each eye for guiding a crossing thread passes alternately on either side of the vertical plane in which the corresponding additional warp thread is located, said bar-actuating means comprising two inclined actuating elements which cooperate respectively with matching elements of the two bars, which comprises a hook for counterbalancing the thread floats during formation of the selvedge, which hook extends parallel to the fell, in the vicinity of the tongues for guiding the additional warp threads, and performs an upward and downward movement in time with the pivoting movement of the first oscillating lever which carries the said tongues.

6. Device as claimed in claim 5, wherein the hook for counterbalancing the thread floats consists of a curved end of a rod which is clamped in a bracket mounted on a pivot fixed on the support and which is mounted in sliding fashion in another bracket mounted on another pivot fixed on the arm of the first oscillating lever which already carries the tongues.

7. Device for producing a false selvedge on a weaving machine by means of at least one additional warp thread and two crossing threads crossworked so as to form a gauze shed, which comprises:

a support to be fixed on the weaving machine alongside one end of the shed, a first spindle carried by said support and parallel to the fell, a first oscillating lever mounted so as to pivot on said first spindle, at least one tongue provided on said lever, said tongue having at its end an eye for guiding an additional warp thread, the amplitude of the oscillating movements of the path of travel of the said first oscillating lever being such that the eyes of the tongues move between the plane of one of the sheets of the shed and a position located beyond the bisecting plane of the shed, a second spindle carried by said support and parallel to the fell, a second oscillating lever mounted so as to pivot on said second spindle, two bars provided on said second oscillating lever, said bars being parallel to the fell and movable against each other in a direction parallel to the fell and each having at least one eye for guiding a crossing thread, the amplitude of the oscillating movements and the path of travel of said second oscillating lever being such that the eyes for guiding the crossing threads move between the plane of the other sheet of the shed and a position located beyond the bisecting plane of the shed, a primary rotating element rotatably mounted on said support, means operatively connected to said primary rotating element for actuating pivoting of said two oscillating levers, which means being designed so that the eyes of the tongues for guiding the additional warp threads and the eyes of the bars for guiding the crossing threads have opposite phasing, at a rate which is a submultiple of that of the formation of the shed, and bar actuating means operatively connected to said primary rotary element and to said crossing thread guiding bars to impart an alternating movement of relative displacement to said two bars, so that they move, in opposite directions, in the vicinity of one of the ends of the travel of said second oscillating lever which carries them, and the length and location of the path of travel of each bar being such that each eye for guiding a crossing thread passes alternately on either side of the vertical plane in which the corresponding additional warp thread is located, said bar-actuating means comprising two inclined actuating elements which cooperate respectively with matching elements of the two bars, wherein the second oscillating lever is formed by an assembly of two arms which arranged next to each other and whose distal ends carry the bars for guiding the crossing threads, whereas their proximal ends are mounted so as to rotate freely side by side, respectively, on two parts of a sleeve which rotates on the support on a spindle parallel to the fell and which is linked in rotation with the primary rotating element, the two above-mentioned parts of the sleeve forming, with the axis of rotation of this sleeve, an acute angle "A", thereby constituting the means for actuating the bars for guiding the crossing threads, the two arms being connected to each other by means which allow them to move towards each other or move away from each other slightly during rotation of the sleeve.

8. Device as claimed in claim 7, wherein the means for actuating the two oscillating levers comprise, on the one hand, a linkage between the first lever and the primary rotating element and, on the other hand, a linkage between the second lever and the first lever.

9. Device as claimed in claim 7, wherein the linkage between the first lever and the primary rotating element comprises a roller mounted on a spindle which in integral with the said lever and which is pushed by a spring towards a cam linked in rotation with the primary rotating element.

10. Device as claimed in claim 7, wherein the two oscillating levers are mounted so as to pivot on two separate parallel spindles and wherein the linkage between the two levers consists of a small connecting rod articulated, on the one hand, at an intermediate point of the second lever and, on the other hand, at a point of an extension of the first lever, which is situated between the two pivoting spindles of the two levers.

11. Device for producing a false selvedge on a weaving machine by means of at least one additional warp thread and two crossing threads crossworked so as to form a gauze shed, which comprises:

a support to be fixed on the weaving machine alongside one end of the shed, a first spindle carried by said support and parallel to the fell, a first oscillating lever mounted so as to pivot on said first spindle, at least one tongue provided on said lever, said tongue having at its end an eye for guiding an additional warp thread, the amplitude of the oscillating movements of the path of travel of the said first oscillating lever being such that the eyes of the tongues move between the plane of one of the sheets of the shed and a position located beyond the bisecting plane of the shed, a second spindle carried by said support and parallel to the fell, a second oscillating lever mounted so as to pivot on said second spindle, two bars provided on said oscillating lever, said bars being parallel to the fell and movable against each other in a direction parallel to the fell and each having at least one eye for guiding a crossing thread, the amplitude of the oscillating movements and the path of travel of said second oscillating lever being such that the eyes for guiding the crossing threads move between the plane of the other sheet of the shed and a position located beyond the bisecting plane of the shed, a primary rotating element rotatably mounted on said support, means operatively connected to said primary rotating element for actuating pivoting of said two oscillating levers, which means being designed so that the eyes of the tongues for guiding the additional warp threads and the eyes of the bars for guiding the crossing threads have opposite phasing, at a rate which is a submultiple of that of the formation of the shed, and bar actuating means operatively connected to said primary rotary element and to said crossing thread guiding bars to impart an alternating movement of relative displacement to said two bars, so that they move, in opposite directions, in the vicinity of one of the ends of the travel of said second oscillating lever which carries them, and the length and location of the path of travel of each bar being such that each eye for guiding a crossing thread passes alternately on either side of the vertical plane in which the corresponding additional warp thread is located, said bar-actuating means comprising two inclined actuating elements which cooperate respectively with matching elements of the two bars, wherein the ratio of the speeds of the primary rotating element and of the shed formation, on the one hand, and the ratio of the speeds of the means for actuating pivoting of the two oscillating levers and of the means for actuating the bars for guiding the crossing threads, to the speed of the primary rotating element on the other hand, are such that, during the formation of two sheds, the two oscillating levers perform two forward and return movements and the two bars perform, with respect to each other, a single forward and return movement, the amplitude of the oscillating movements and the path of travel of the first oscillating lever being such that the eyes of the tongues for guiding the additional warp threads move between the plane of one of the sheets of the shed and an intermediate position situated very close to the bisecting plane of the shed, whereas the amplitude of the oscillating movements and the path of travel of the second oscillating lever are such that the eyes of the bars for guiding the crossing threads move between the plane of the other sheet of the shed and an intermediate position situated very close to the bisecting plane of the shed.

12. Device for producing a false selvedge on a weaving machine by means of at least one additional warp thread and two crossing threads crossworked so as to form a gauze shed, which comprises:

a support to be fixed on the weaving machine alongside one end of the shed, a first spindle carried by said support and parallel to the fell, a first oscillating lever mounted so as to pivot on said first spindle, at least one tongue provided on said lever, said tongue having at its end an eye for guiding an additional warp thread, the amplitude of the oscillating movements of the path of travel of the said first oscillating lever being such that the eyes of the tongues move between the plane of one of the sheets of the shed and a position located beyond the bisecting plane of the shed, a second spindle carried by said support and parallel to the fell, a second oscillating lever mounted so as to pivot on said second spindle, two bars provided on said second oscillating lever, said bars being parallel to the fell and movable against each other in a direction parallel to the fell and each having at least one eye for guiding a crossing thread, the amplitude of the oscillating movements and the path of travel of said second oscillating lever being such that the eyes for guiding the crossing threads move between the plane of the other sheet of the shed and a position located beyond the bisecting plane of the shed, a primary rotating element rotatably mounted on said support, means operatively connected to said primary rotating element for actuating pivoting of said two oscillating levers, which means being designed so that the eyes of the tongues for guiding the additional warp threads and the eyes of the bars for guiding the crossing threads have opposite phasing, at a rate which is a submultiple of that of the formation of the shed, and bar actuating means operatively connected to said primary rotary element and to said crossing thread guiding bars to impart an alternating movement of relative displacement to said two bars, so that they move, in opposite directions, in the vicinity of one of the ends of the travel of said second oscillating lever which carries them, and the length and location of the path of travel of each bar being such that each eye for guiding a crossing thread passes alternately on either side of the vertical plane in which the corresponding additional warp thread is located, said bar-actuating means comprising two inclined actuating elements which cooperate respectively with matching elements of the two bars, wherein the ratio of the speeds of the primary rotating element and the shed formation, on the one hand, and the ratio of the speeds of the means for actuating pivoting of the two oscillating levers and of the means for actuating the bars for guiding the crossing threads, to the speed of the primary rotating element, on the other hand, are such that, during formation of four sheds, the two oscillating levers perform two forward and backward movements and the two bars perform, with respect to each other, a single forward and backward movement, the amplitude of the oscillating movements and the path of travel of the two oscillating levers being such that, when these two levers are in their end positions, the eyes for guiding the additional warp threads and the eyes for guiding the crossing threads are alternately in the plane of each of the two sheets of the shed.

* * * * *

UNITED STATES PATENT AND TRADEMARK OFFICE

CERTIFICATE OF CORRECTION

PATENT NO. : 4,580,605

DATED : April 8, 1986

INVENTOR(S) : Guy Gosciniak and Pascal Scherrer

It is certified that error appears in the above-identified patent and that said Letters Patent are hereby corrected as shown below:

Column 2, line 48, "machanism" should be -- mechanism --

Column 12, line 63, -- are -- is omitted after "which".

Column 13, claim 11, line 51, -- second -- is omitted after "said".

Signed and Sealed this

Seventh Day of April, 1987

*Attest:*

*Attesting Officer*

DONALD J. QUIGG

*Commissioner of Patents and Trademarks*